US008695853B2

(12) United States Patent
Savan et al.

(10) Patent No.: US 8,695,853 B2
(45) Date of Patent: Apr. 15, 2014

(54) HOUSEHOLD APPLIANCE HAVING ICE WATER DISPENSER

(75) Inventors: Mehmet Savan, Tekirdag (TR); Nilhan Sevgi, Tekirdag (TR); Tolga Yegin, Izmir (TR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 87 days.

(21) Appl. No.: 13/300,694

(22) Filed: Nov. 21, 2011

(65) Prior Publication Data

US 2012/0152983 A1 Jun. 21, 2012

(30) Foreign Application Priority Data

Dec. 15, 2010 (TR) ..... a 2010 10473

(51) Int. Cl.
*B67D 7/84* (2010.01)
*F25D 3/00* (2006.01)
*B65B 1/04* (2006.01)

(52) U.S. Cl.
USPC ..... 222/173; 62/389; 141/86

(58) Field of Classification Search
USPC ..... 222/146.6, 173, 505, 504, 108; 141/86, 141/351, 360, 362, 369; 62/389–400, 331; 312/404, 405, 236, 234, 352, 327
See application file for complete search history.

(56) References Cited

U.S. PATENT DOCUMENTS

| | | | | |
|---|---|---|---|---|
| 5,033,273 | A * | 7/1991 | Buchser et al. | 62/344 |
| 7,287,555 | B2 * | 10/2007 | Heger et al. | 141/86 |
| 7,757,732 | B2 * | 7/2010 | Voglewede et al. | 141/360 |
| 7,762,292 | B2 * | 7/2010 | Buchstab et al. | 141/369 |
| 7,793,690 | B2 * | 9/2010 | Voglewede et al. | 141/362 |
| 8,328,054 | B2 * | 12/2012 | Oh | 222/504 |
| 8,348,108 | B2 * | 1/2013 | Choi | 222/504 |
| 2008/0184730 | A1 * | 8/2008 | Voglewede et al. | 62/389 |
| 2009/0282857 | A1 | 11/2009 | An et al. | |
| 2009/0308493 | A1 * | 12/2009 | Buchstab et al. | 141/378 |
| 2009/0314025 | A1 | 12/2009 | Kuemmel | |
| 2010/0259147 | A1 | 10/2010 | Koo | |

OTHER PUBLICATIONS

European Search Report EP 11 19 2815 dated Dec. 4, 2013.

* cited by examiner

*Primary Examiner* — Kevin P Shaver
*Assistant Examiner* — Stephanie E Williams
(74) *Attorney, Agent, or Firm* — James E. Howard; Andre Pallapies

(57) ABSTRACT

A refrigerator having an ice water dispenser either with an overlap frame or flush frame. The ice water dispenser has a dispenser inner sheet and dispenser outer body onto which a dispenser face cover sheet is attached by way of lateral rips. The dispenser face cover sheet is fixed to cover the periphery of the outer body with respective openings for buttons.

20 Claims, 6 Drawing Sheets

HOUSEHOLD APPLIANCE HAVING ICE WATER DISPENSER

BACKGROUND OF THE INVENTION

The present invention relates to an electrical household appliance and in particular to a refrigerator's ice water dispenser.

The present invention relates to an electrical household appliance having an ice water dispenser for conveniently serving ice and water as is the case for many advanced category refrigerators.

The ice water dispenser according to the present invention features a set of properties to ensure both a more pleasing visual appearance and a more robust mechanical connection in between the components of said dispenser.

To this end, the existing ice water dispenser is modified such that it is more reliable in terms of mechanical stability and more appealing on the part of users.

On the other hand, a more appealing visual appearance is obtained by way of replacing plastic contours of the ice water dispenser with a metallic look body.

BRIEF SUMMARY OF THE INVENTION

The most prominent object of the present invention is to provide an ice water dispenser having a more robust mechanical connection in between its components.

Another object of the present invention is to provide an ice water dispenser more reliable in terms of mechanical stability.

The present invention provides a refrigerator having an ice water dispenser either with an overlap frame or flush frame. Said ice water dispenser has a dispenser inner sheet and dispenser outer body onto which a dispenser face cover sheet is attached by means of lateral rips. Said dispenser face cover sheet is fixed to cover the periphery of said outer body with respective openings for buttons.

BRIEF DESCRIPTION OF THE DRAWINGS

The figures whose brief explanations are herewith provided are solely intended for providing a better understanding of the present invention and are as such not intended to define the scope of protection or the context in which said scope is interpreted in the absence of the description. To this end, FIGS. 1 *a* and 1 *b* demonstrate front and rear perspective views of an overlap frame for an ice water dispenser according to the present invention.

DETAILED DESCRIPTION OF EXEMPLARY EMBODIMENTS OF THE PRESENT INVENTION

Figure 1A:
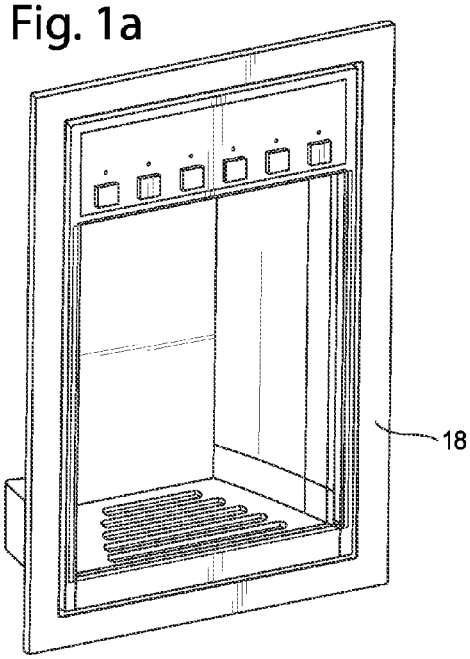

The present invention proposes an electrical household appliance and more particularly a refrigerator having an ice water dispenser. The ice water dispenser is designed either with an overlap frame or flush frame as seen in respectively FIGS. 1 and 2.

Said ice water dispenser has a dispenser inner sheet (15) and dispenser outer body (11) onto which a dispenser face cover sheet (12) is attached by means of lateral rips (13). Said dispenser face cover sheet (12) is fixed to cover the periphery of said outer body (11) with respective openings for buttons (14).

Said dispenser face cover sheet (12) is fixed to said dispenser outer body (11) by means of a screw (16). To this end, displacement of said dispenser face cover sheet (12) in longitudinal and transversal axes of said dispenser outer body (11) is prevented and a secure connection is established.

Figure 10:
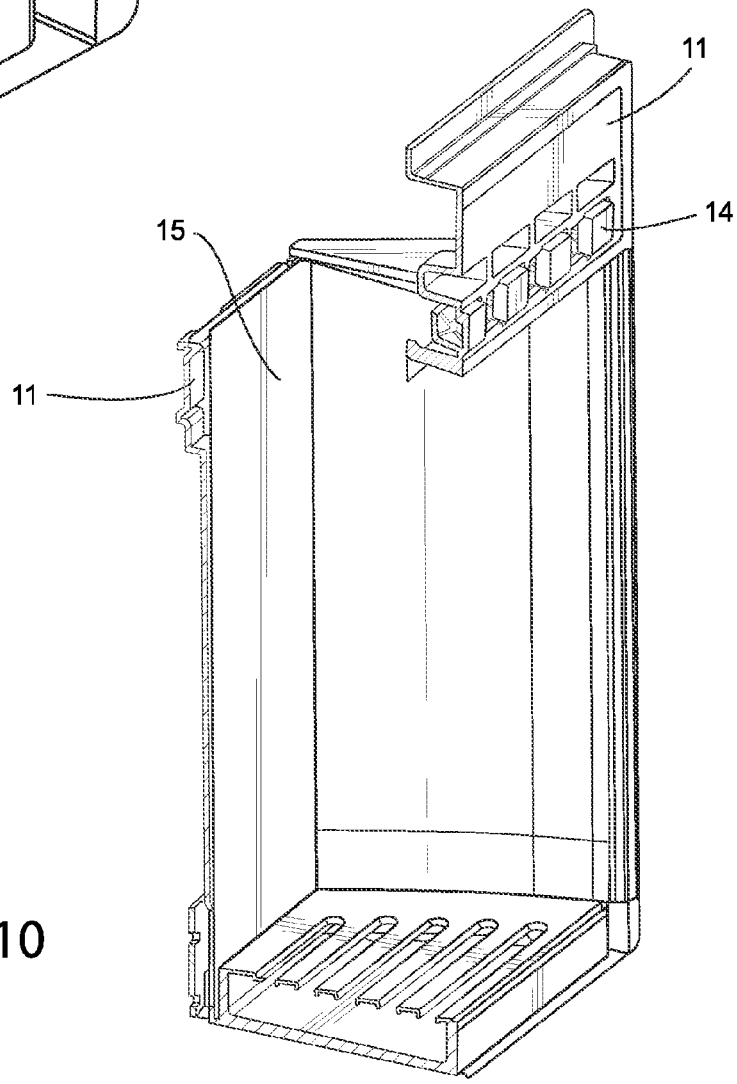
FIG. 10 demonstrates the relationship between said dispenser outer body and said dispenser inner sheet at the middle section according to the present invention.

According to the present invention, said dispenser outer body (11) and said dispenser inner sheet (15) are connected to each other by means of an S-form cross-section inter-engaging connection (17). This S-form cross-section inter-engaging connection (17) provides secure connection of said dispenser outer body (11) with said dispenser inner sheet (15) at both sides along the longitudinal edges of said dispenser outer body (11). FIG. 10 represents the relationship between said dispenser outer body (11) and said dispenser inner sheet (15) at the middle section where there is a clearance of 1 mm in between said outer body (11) and said inner sheet (15).

Figure 1B:
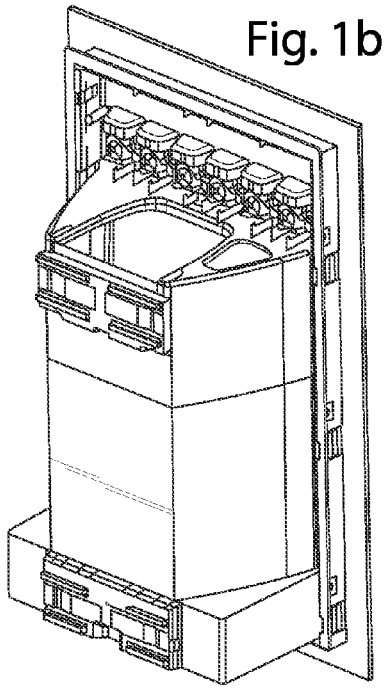
Figure 2A:
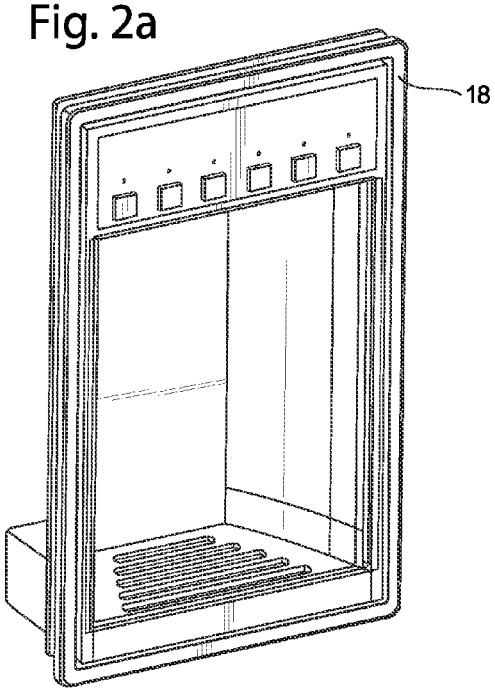
FIGS. 2*a* and 2*b* demonstrate front and rear perspective views of a flush frame for an ice water dispenser according to the present invention.
Figure 2B:
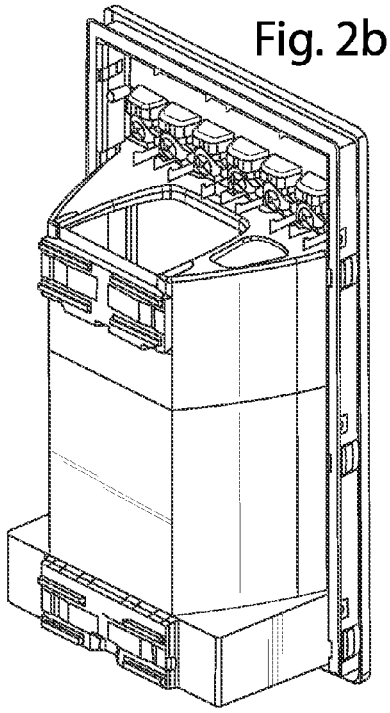
Figure 3A:
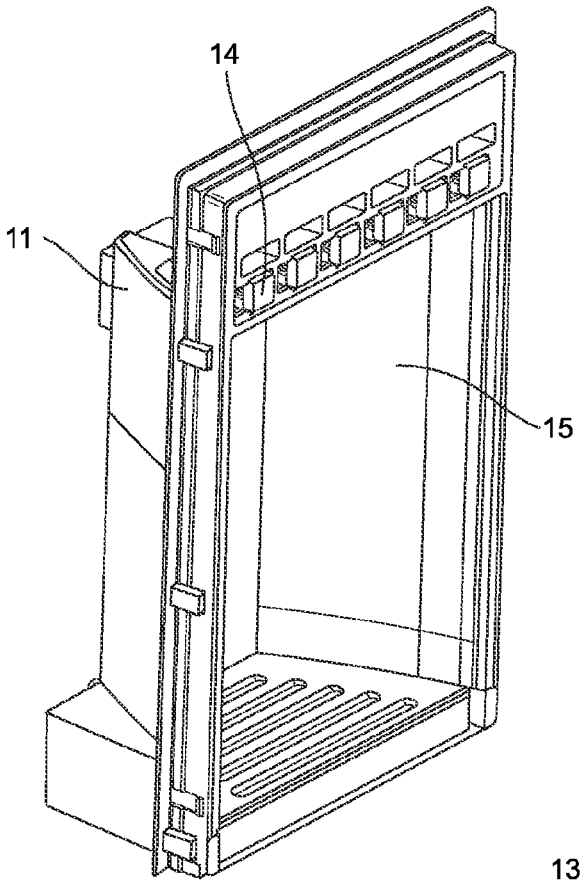
FIG. 3*a* demonstrates a perspective view of the dispenser body and FIG. 3*b* demonstrates a perspective view of a dispenser body with a dispenser face cover sheet according to the present invention.
Figure 3B:
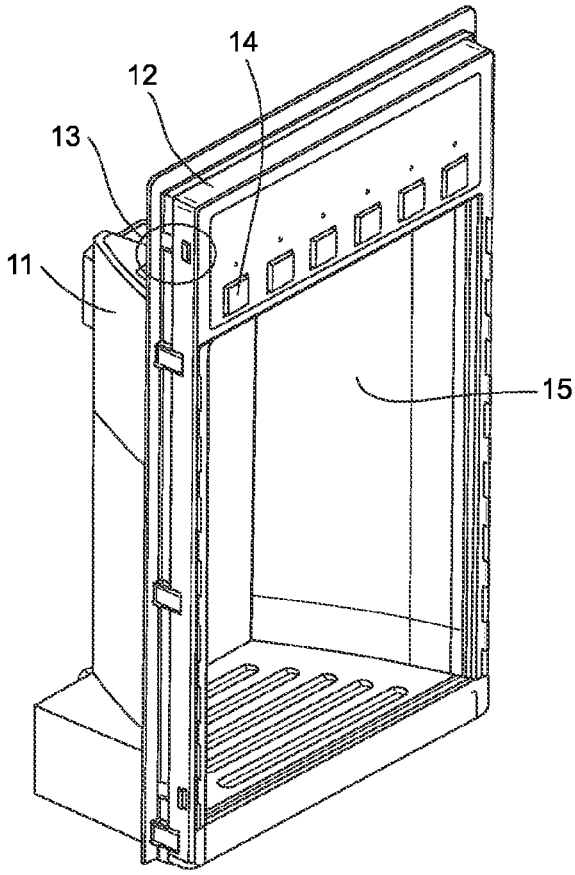
Figure 4A:
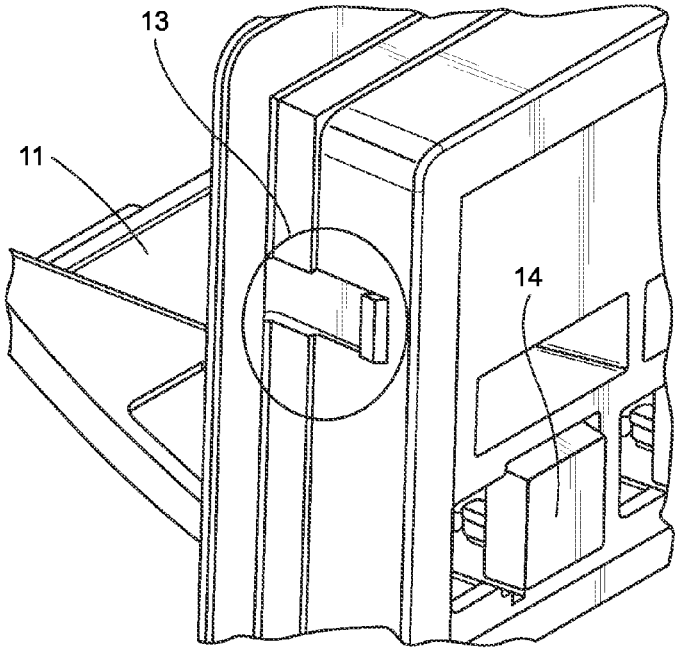
FIGS. 4*a* and 4*b* demonstrate enlarged views of the upper parts of the dispenser given in FIGS. 3*a* and 3*b*.
Figure 4B:
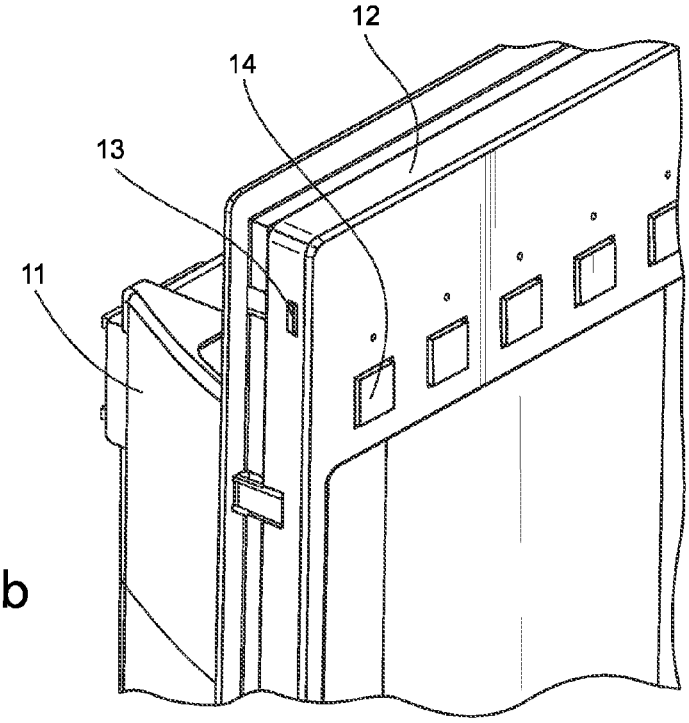
Figure 5:
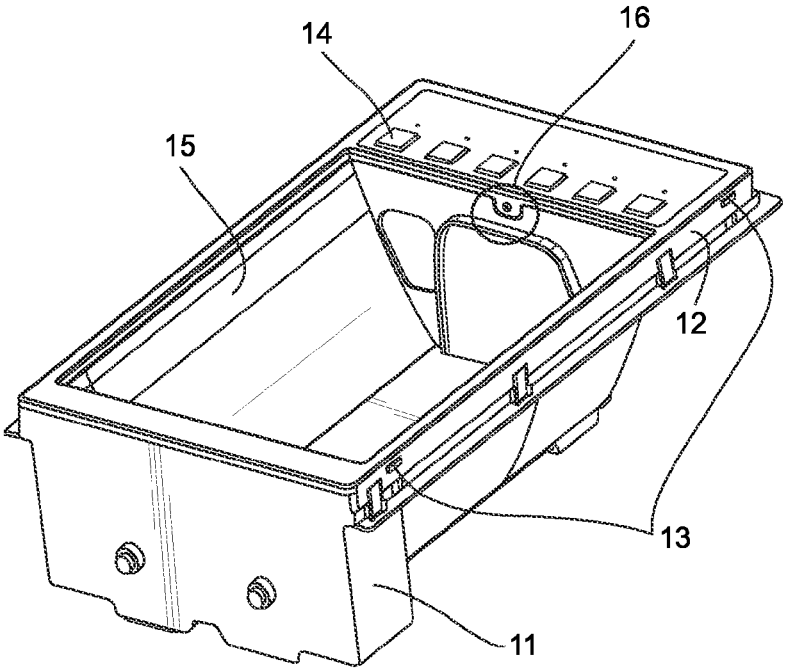
FIG. 5 demonstrates a perspective view of the dispenser body with the dispenser face cover sheet according to the present invention.
Figure 6:
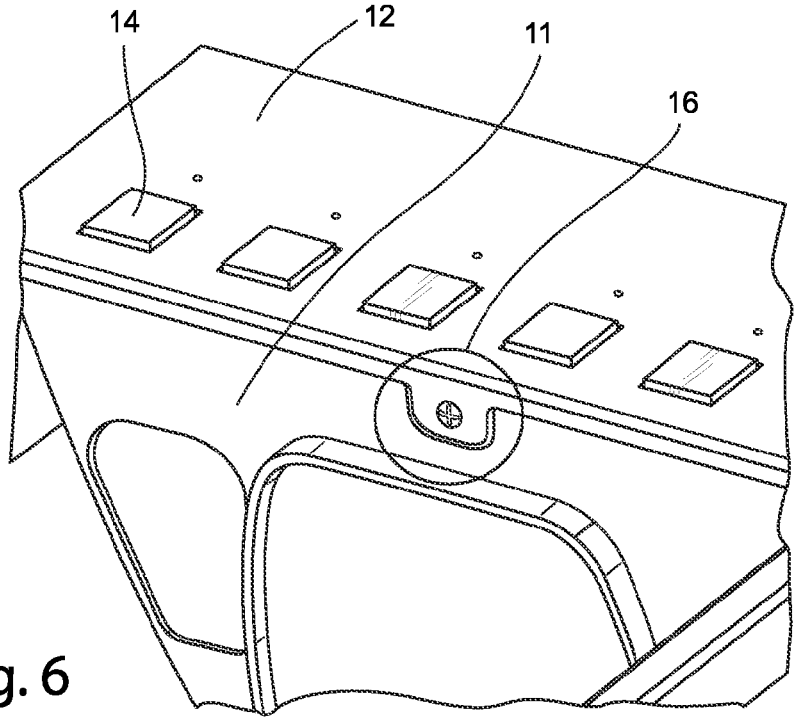
FIG. 6 demonstrates enlarged views of the upper parts of the dispenser given in FIG. 5.
Figure 7:
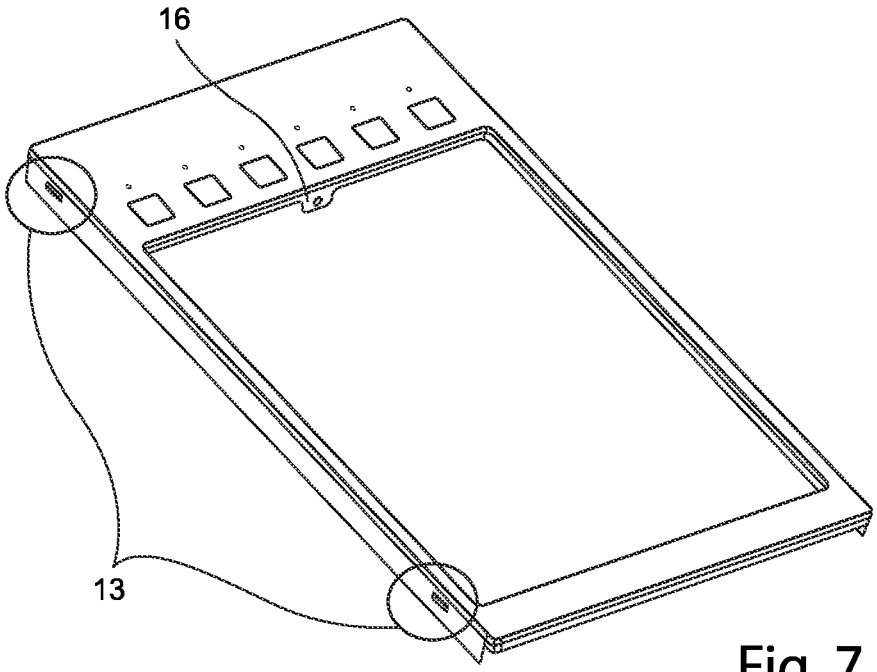
FIG. 7 demonstrates a perspective view of the dispenser face cover sheet alone according to the present invention.
Figure 8:
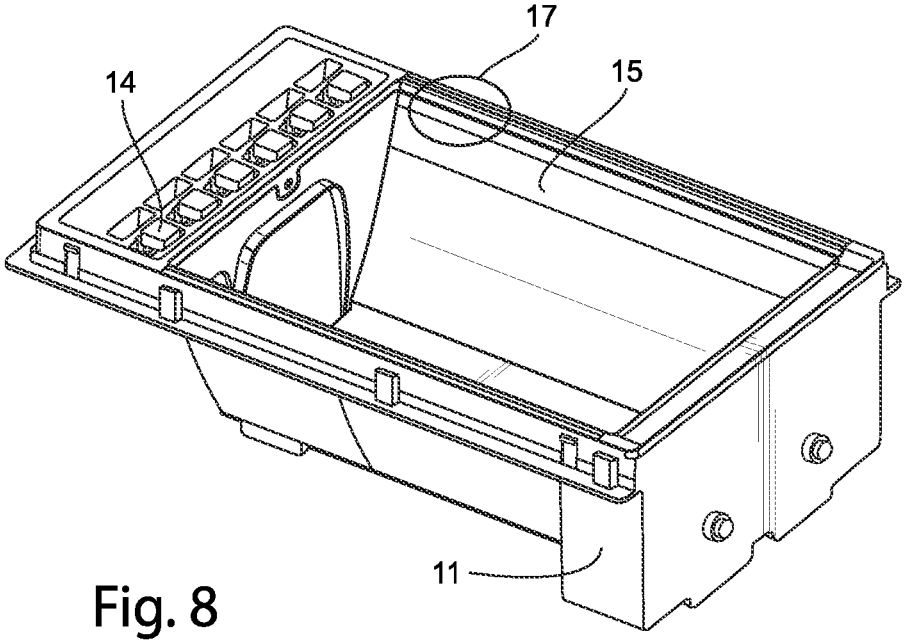
FIG. 8 demonstrates a perspective view of the dispenser body with the dispenser inner sheet connection detail according to the present invention.
Figure 9:
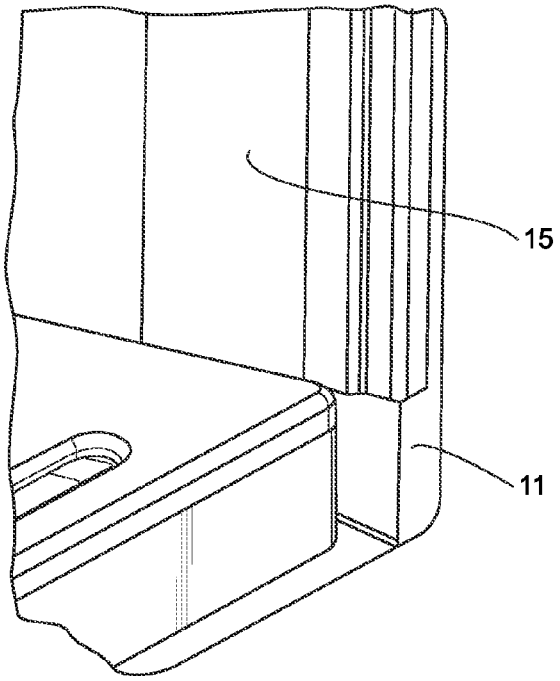
FIG. 9 demonstrates a perspective enlarged view of the dispenser body with the dispenser inner sheet connection detail according to the present invention.

In the case of flush or overlay frames, an acrylic based double-sided adhesive strip (not shown) is applied on the dispenser surface. FIGS. 1*a* and 2*a* respectively demonstrate the overlay and flush frames fixed on the double-sided adhesive strips.

In a nutshell, the present invention provides an ice water dispenser having a dispenser inner sheet (15) for covering an inner region of said dispenser delimited by a front part including the front peripheral region thereof and a dispenser outer body (11) onto which a dispenser face cover sheet (12) is attached such that the periphery of said outer body (11) is covered with openings for serving operation buttons (14), said ice water dispenser also having a flush or overlay frame (18) covering said front peripheral region.

What is claimed is:

1. An ice water dispenser comprising:

a dispenser outer body, a dispenser inner sheet that covers an inner region of said dispenser delimited by a front part including a front peripheral region thereof and the dispenser outer body, a dispenser face cover sheet attached to the dispenser outer body such that the periphery of said outer body is covered, the dispenser face cover sheet including openings for serving operation buttons, and a flush or overlay frame covering said front peripheral region.

2. An ice water dispenser as set forth in claim 1 wherein said dispenser face cover sheet is attached to said dispenser outer body by means of lateral rips.

3. An ice water dispenser as set forth in claim 1 wherein said dispenser face cover sheet is fixed to said dispenser outer body by means of a screw that prevents displacement of said dispenser face cover sheet in longitudinal and transversal axes of said dispenser outer body.

4. An ice water dispenser as set forth in claim 1 wherein said dispenser outer body and said dispenser inner sheet are connected to each other by means of an S-form cross-section inter-engaging connection.

5. An ice water dispenser as set forth in claim 4 wherein said S-form cross-section inter-engaging connection provides connection of said dispenser outer body with said dispenser inner sheet at two sides along the longitudinal edges of said dispenser outer body.

6. An ice water dispenser as set forth in claim 4 wherein a relationship between said dispenser outer body and said dispenser inner sheet at a middle section is such that there is a clearance of 1 mm in between said outer body and said inner sheet at the middle section.

7. An ice water dispenser as set forth in claim 1 wherein said flush or overlay frame is attached on the front peripheral region of said dispenser outer body by an acrylic based double-sided adhesive strip.

8. An ice water dispenser as set forth in claim 2 wherein the lateral rips comprise protrusions extending from the dispenser outer body and corresponding holes on the dispenser face cover sheet.

9. An ice water dispenser as set forth in claim 3 wherein the screw is disposed between an outer-most surface of the dispenser face cover sheet and the dispenser inner sheet on an upper internal wall of the dispenser outer body.

10. An ice water dispenser comprising:

a main body that defines an recess for dispensing ice and water;

an inner sheet that covers an inner contour of the recess;

a cover component, attached to the main body, that covers a periphery of the main body when viewed towards a front side of the recess, and that covers an interface between the inner sheet and the main body; and a frame that covers at least part of the cover component.

11. The ice water dispenser according to claim 10, wherein the cover component is attached to the main body by a snap fit.

12. The ice water dispenser according to claim 10, wherein the cover component is generally rectangular with a rectangular opening to provide access to the recess and at least one opening through which a button can be actuated.

13. The ice water dispenser according to claim 12, wherein the cover component further comprises lateral side walls that extend rearward and cover at least a portion of a side of the main body.

14. The ice water dispenser according to claim 10, wherein the recess is generally U-shaped in a horizontal cross-section.

15. The ice water dispenser according to claim 10, wherein the cover component is attached to the main body by way of a screw located within the recess.

16. The ice water dispenser according to claim 10, wherein the inner sheet is attached to the main body along two longitudinal edges of the main body at the recess.

17. The ice water dispenser according to claim 10, wherein a clearance is provided between the inner sheet and the main body.

18. The ice water dispenser according to claim 10, further comprising an adhesive to attach the frame to the cover component.

19. The ice water dispenser according to claim 10, wherein the recess includes a front opening adapted to allow access by a user and a top opening through which ice and/or water is dispensed.

20. The ice water dispenser according to claim 19, wherein a screw that attaches the cover component to the main body is located on an upper inner wall of the recess, between the top opening and a front face of the cover component.

* * * * *